US008207458B2

(12) United States Patent
Chen et al.

(10) Patent No.: US 8,207,458 B2
(45) Date of Patent: Jun. 26, 2012

(54) ARTICLE WITH CIRCUIT ACTUATING CAPABILITY

(75) Inventors: Jen-Lin Chen, Cupertino, CA (US); Han-Chao Chang, Tainan (TW)

(73) Assignee: Jen-Lin Chen, Cupertino, CA (US)

( * ) Notice: Subject to any disclaimer, the term of this patent is extended or adjusted under 35 U.S.C. 154(b) by 791 days.

(21) Appl. No.: 12/298,301

(22) PCT Filed: May 18, 2006

(86) PCT No.: PCT/US2006/019428

§ 371 (c)(1),
(2), (4) Date: Feb. 26, 2009

(87) PCT Pub. No.: WO2007/133217

PCT Pub. Date: Nov. 22, 2007

(65) Prior Publication Data

US 2009/0220928 A1 Sep. 3, 2009

(30) Foreign Application Priority Data

Apr. 25, 2006 (DE) ..... 20 2006 006 577 U

(51) Int. Cl.
*H01H 27/00* (2006.01)

(52) U.S. Cl. ..... 200/43.04; 434/317

(58) Field of Classification Search ..... 200/5 A, 200/506, 61.62, 61.7, 43.04, 43.05; 434/224, 434/317, 379

See application file for complete search history.

(56) References Cited

U.S. PATENT DOCUMENTS

| | | | | |
|---|---|---|---|---|
| 4,706,536 | A * | 11/1987 | Sanders | 84/719 |
| 6,655,586 | B1 | 12/2003 | Back et al. | |
| 6,697,602 | B1 * | 2/2004 | Ferrigno et al. | 434/308 |
| 7,167,675 | B2 | 1/2007 | Lynch et al. | |
| 2003/0170604 | A1 | 9/2003 | Mullen | |

* cited by examiner

*Primary Examiner* — Renee Luebke
*Assistant Examiner* — Lheiren Mae Caroc

(57) ABSTRACT

An article with circuit actuating capability includes a first article part [13], a second article part [11] formed with a pocket [101] and linked to the first article part such that the first and second article parts being movable relative to each other, the pocket having an access opening [113], and a circuit [2] built in the pocket in the second article part and accessible through the access opening of the pocket for controlling circuit states of the circuit.

23 Claims, 15 Drawing Sheets

ARTICLE WITH CIRCUIT ACTUATING CAPABILITY

BACKGROUND OF THE INVENTION

1. Field of the Invention

This invention relates to an article with circuit actuating capability, more particular to an article formed with a pocket and having a circuit built in the pocket and accessible through an opening of the pocket.

2. Description of the Related Art

Conventional articles, such as audio books and audio greeting cards, with sound generating capability normally include an integrated circuit with a speaker coupled thereto. The circuit can be actuated upon opening of the audio greeting cards or the audio books, thereby generating a sound output. However, the circuit built in the conventional greeting cards or the audio books cannot be controlled by the user. For instance, in some circumstances, the user may want to turn off the circuit so that no sound is generated when the user opens the audio greeting card or the audio book.

SUMMARY OF THE INVENTION

Therefore, the object of the present invention is to provide an article with circuit actuating capability that can overcome the aforesaid drawback of the prior art.

According to one aspect of the present invention, there is provided an article with circuit actuating capability. The article comprises: a first article part; a second article part formed with a pocket and linked to the first article part such that the first and second article parts being movable relative to each other, the pocket having an access opening; and a circuit built in the pocket in the second article part and accessible through the access opening of the pocket for controlling circuit states of the circuit.

According to another aspect of the present invention, there is provided a book with circuit actuating capability. The book comprises: a book body formed with a pocket that has an access opening; and a circuit built in the pocket and including a first switch unit that is accessible through the access opening of the pocket to control circuit states of the circuit.

According to yet another aspect of the present invention, there is provided an article with circuit actuating capability. The article comprises: a first article part; a second article part linked to the first article part such that the first and second article parts are movable relative to each other between first and second positions; a circuit built in one of the first and second article parts and having power states and operating states; a first switch unit coupled to the circuit so as to control the power states of the circuit; and a second switch unit coupled to the circuit so as to detect the first and second positions of the first and second article parts and so as to generate signals corresponding respectively to the operating states of the circuit.

According to still another aspect of the present invention, there is provided a book with circuit actuating capability. The book comprises: a book body operable between opened and closed states; a circuit built in the book body and having power states and operating states; a first switch unit coupled to the circuit so as to control the power states of the circuit; and a second switch unit coupled to the circuit so as to detect the opened and closed states of the book body and so as to generate signals corresponding respectively to the operating states of the circuit.

BRIEF DESCRIPTION OF THE DRAWINGS

In drawings which illustrate embodiments of the invention.

DETAILED DESCRIPTION OF THE PREFERRED EMBODIMENTS

Figure 1:
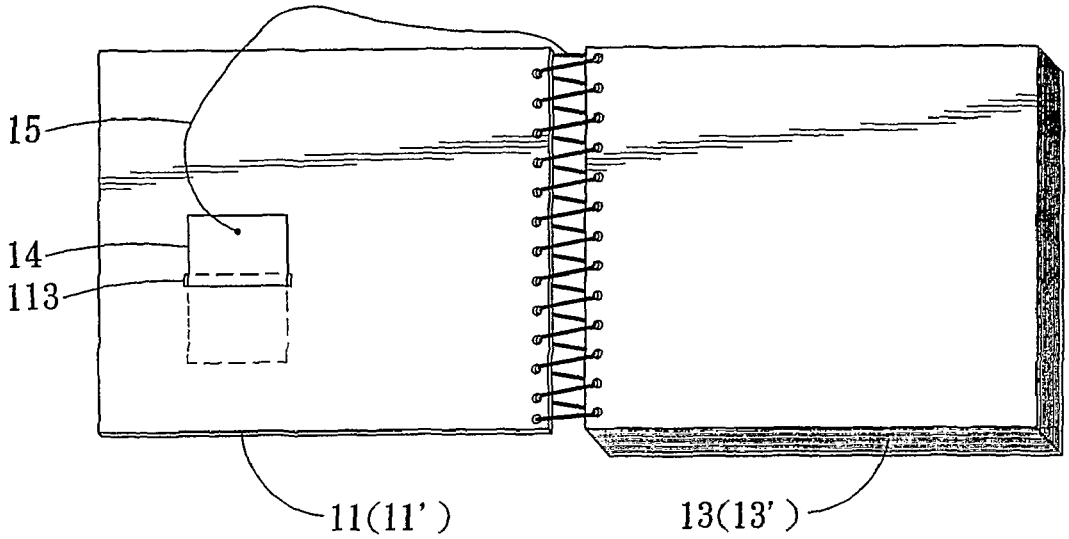
FIG. 1 is a schematic view of the first preferred embodiment of an article in the form of a notebook according to this invention, illustrating a state where the notebook is disposed at an opened condition and where a controlling member is inserted into a pocket in a cover panel of the notebook.
Figure 2:
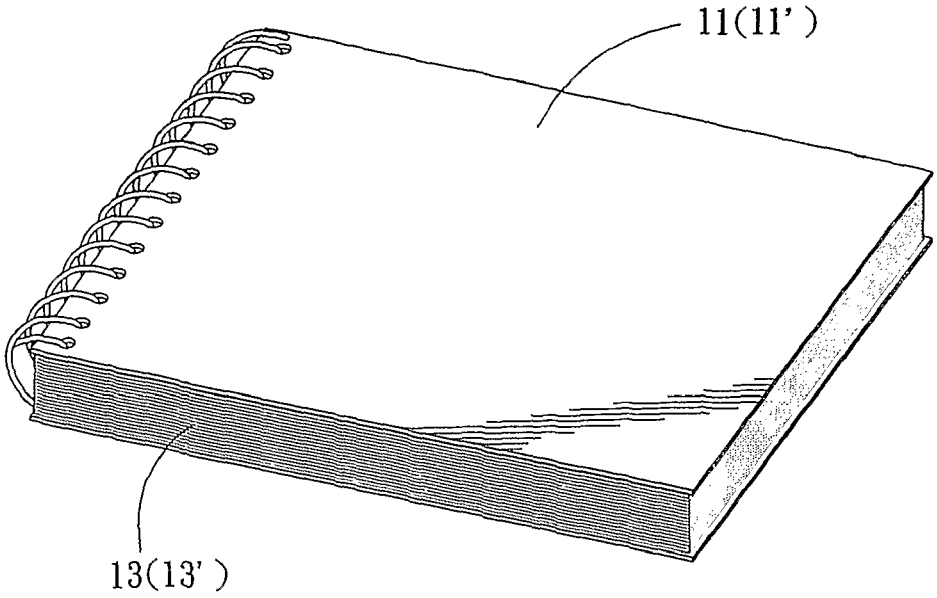
FIG. 2 is a perspective view of the first preferred embodiment, illustrating a state where the notebook is disposed at a closed condition.
Figure 3:
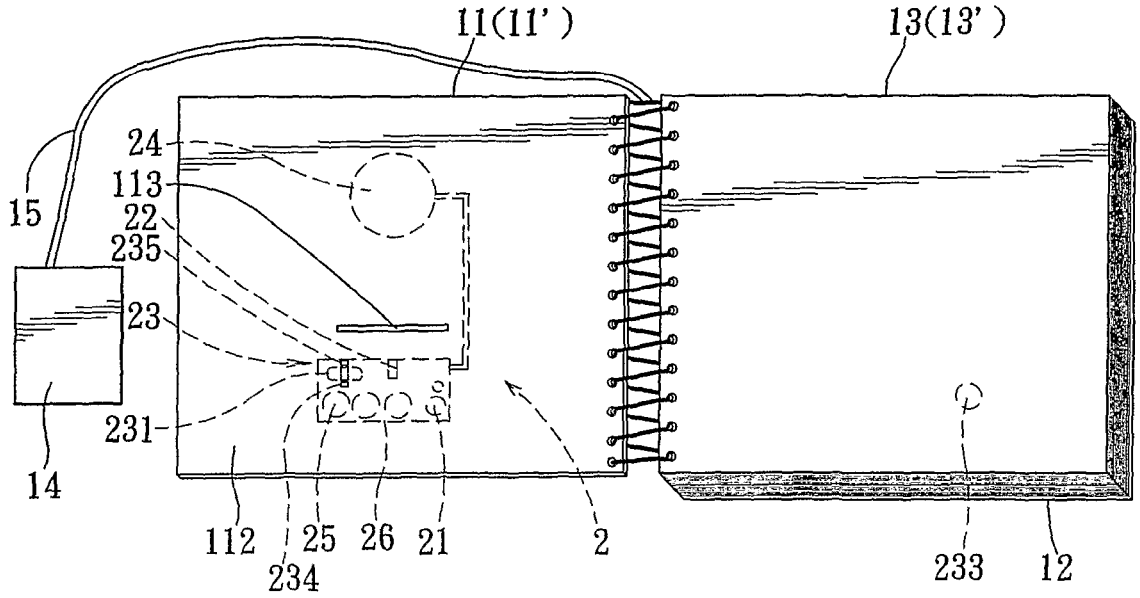
FIG. 3 is a perspective view to illustrate a state where the controlling member is removed from the pocket in the cover panel of the notebook.
Figure 4:
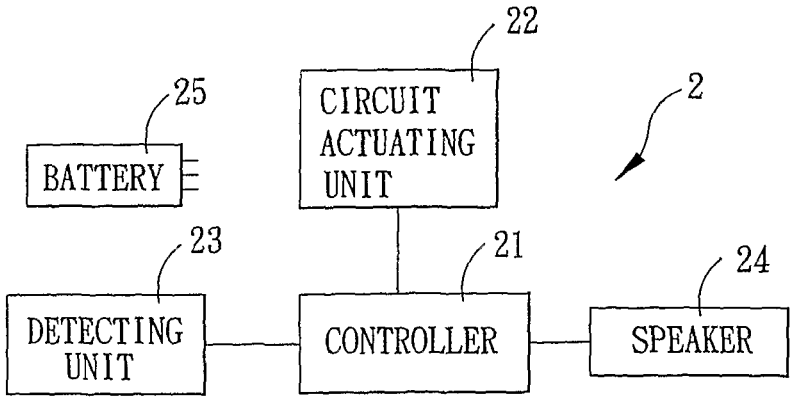
FIG. 4 is a block diagram to illustrate elements of a circuit of the first preferred embodiment.

Before the present invention is described in greater detail, it should be noted that same reference numerals have been used to denote like elements throughout the specification, and that the term "book" described hereinafter is used to represent general books, notebooks, binders, and the like.

FIGS. 1 to 6 illustrate the first preferred embodiment of an article in the form of a notebook with circuit actuating capability.

The notebook includes a book body having: a first article part 13; a second article part 11 formed with a pocket 101 and connected to the first article part 13, the pocket 101 having a slit-like access opening 113, the first and second article parts 13, 11 being movable relative to each other between a first position (i.e., a closed state) (see FIG. 2), in which the access opening 113 of the pocket 101 is covered by the first article part 13, thereby denying access into the pocket 101, and a second position (i.e., an opened state) (see FIGS. 1 and 3), in which the access opening 113 of the pocket 101 is exposed from the first article part 13, thereby permitting access into the pocket 101; a circuit 2 (see FIGS. 3 and 4) built in the pocket 101 in the second article part 11 and accessible through the access opening 113 of the pocket 101; and a controlling member 14 connected detachably to the second article part 11 through a string 15 which is connected to a binding ring, and insertable into the pocket 101 through the access opening 113 for controlling the circuit states of the circuit 2.

The first article part 13 includes a stack of printable sheets 13' that are bound together. The second article part 11 includes an upper cover panel 11' connected to the stack of the printable sheets 13'. The upper cover panel 11' is formed with the pocket 101 and lies over a topmost one of the printable sheets 13' when the first and second article parts 13, 11 are disposed at the first position. The upper cover panel 11' includes a board body 111 and a rear cover sheet 112 covering a rear side of the board body 111. The circuit 2 is mounted on the board body 111, and is covered by the rear cover sheet 112. The access opening 113 of the pocket 101 is formed in the rear cover sheet 112.

In this embodiment, the circuit 2 includes a circuit board 26 disposed in the pocket 101, and a first switch unit 22 having first and second conductive traces 222, 224 that are formed on the circuit board 26 and that are spaced apart from each other. The controlling member 14 is associated with the first and second conductive traces 222, 224 in such a manner that electrical connection and disconnection between the first and second conductive traces 222, 224, which correspond to respective ones of the circuit states of the circuit 2, such as activation and deactivation of the circuit 2, are controlled by insertion and removal of the controlling member 14 into and out of the pocket 101.

Figure 5:
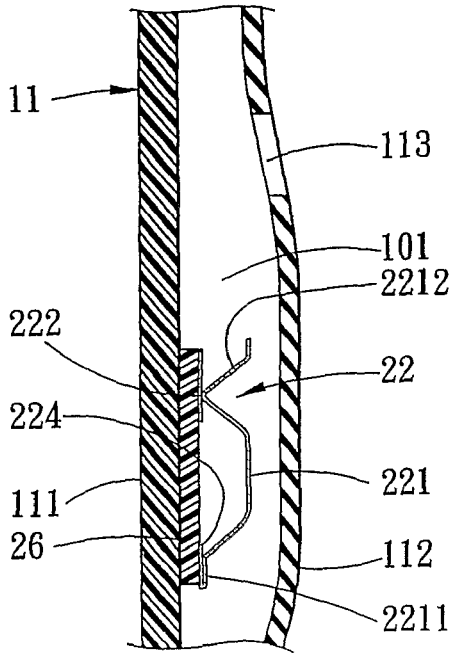
FIG. 5 is a fragmentary sectional view to illustrate a state where two conductive traces of a first switch unit of the first preferred embodiment are connected to activate the circuit.
Figure 6:
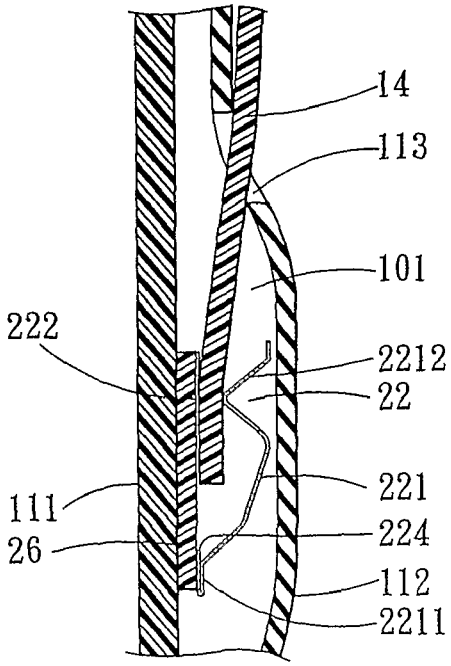
FIG. 6 is a fragmentary sectional view to illustrate how the conductive traces of the first switch unit of the first preferred embodiment are disconnected by the controlling member for deactivating the circuit.

In this embodiment, the first switch unit 22 further has a resilient conductive spring arm 221 that has a fixed end 2211 connected to the second conductive trace 224, and a free end 2212 opposite to the fixed end 2211 and aligned with the first conductive trace 222. The free end 2212 of the conductive spring arm 221 is resilient and is self-urged toward and to contact the first conductive trace 222, thereby activating the circuit 2, as best shown in FIG. 5. The controlling member 14 is in the form of a dielectric card, such as a book mark, that separates the free end 2212 of the conductive spring arm 221 from the first conductive trace 222 (see FIG. 6) when the controlling member 14 is inserted into the pocket 101, thereby deactivating the circuit 2.

The circuit 2 further includes a second switch unit 23 for detecting the first and second positions of the first and second article parts 13, 11 relative to each other. The second switch unit 23 includes first and second conductive contacts 234, 235 that are formed on the circuit board 26 and that are spaced apart from each other, and a detecting reed switch 232 coupled to the first and second conductive contacts 234, 235. The first article part 13 includes a lower cover panel 12 that is opposite to the upper cover panel 11' and that is provided with a magnetic member 233 that interacts with the detecting reed switch 232 for controlling electrical connection and disconnection between the first and second conductive contacts 234, 235, which correspond to respective ones of the operating states of the circuit 2, upon relative movement of the first and second article parts 13, 11 between the first and second positions.

In this embodiment, the circuit 2 further includes a controller 21, which is in the form of a programmable IC chip, for controlling the operating states of the circuit 2, a speaker 24 for generating a sound output, and a power source 25, such as a battery. Note that the circuit 2 may further include a light emitting device, a motor, or a signal generating device, or include one of these components instead of the speaker 24. The controller 21 receives signals, which correspond respectively to the first and second positions of the first and second article parts 13, 11, from the second switch unit 23 so as to control the operating states of the circuit 2. The controller 21 has On and Off power states controlled by the connection and disconnection between the first and second conductive traces 222, 224 which are controlled by insertion and removal of the controlling member 14 into and out of the pocket 101. As such, the speaker 24 controlled by the controller 21 can generate the sound output when the circuit 2 is activated through removal of the controlling member 14 out of the pocket 101, i.e., the controller 21 is disposed at the On power state. However, when the first and second article parts 13, 11 are disposed at the second position (i.e., the opened state), the circuit 2 can be deactivated, i.e., the controller 21 is disposed at the Off power state, through insertion of the controlling member 14 into the pocket 101 even when the first and second article parts 13, 11 are disposed at the second position, thereby preventing generation of the sound output by the speaker 24.

Figure 7:
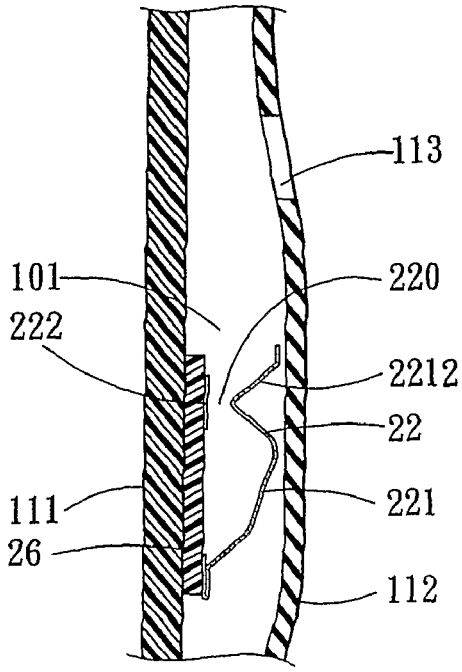
FIG. 7 is a fragmentary sectional view of the second preferred embodiment of the article in the form of a book according to this invention, illustrating a state where the conductive traces of the first switch unit are disconnected.
Figure 8:
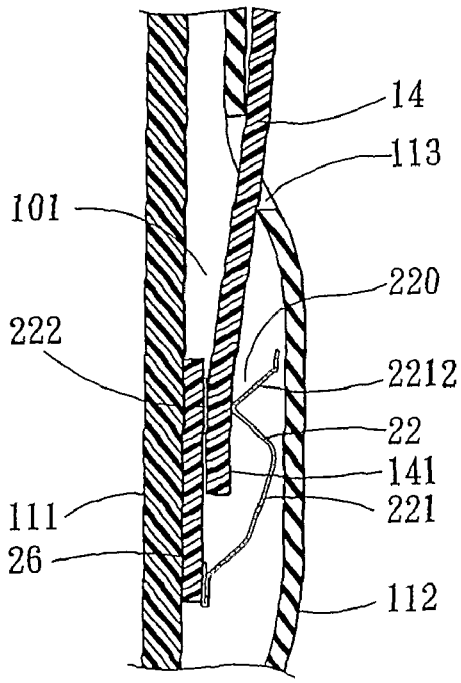
FIG. 8 is a fragmentary sectional view to illustrate how the conductive traces of the first switch unit of the second preferred embodiment are connected by the controlling member.

FIGS. 7 and 8 illustrate the second preferred embodiment of an article in the form of a notebook according to this invention. The notebook of this embodiment differs from the previous embodiment in that the free end 2212 of the conductive spring arm 221 is self-urged away from the first conductive trace 222. As such, the free end 2212 of the conductive spring arm 221 is spaced apart from the first conductive trace 222 by a gap 220. The controlling member 14 is in the form of a card having a conductive end portion 141 extending into the gap 220 and sandwiched between and in electrical contact with the free end 2212 of the conductive spring arm 221 and the first conductive trace 222 when the controlling member 14 is inserted into the pocket 101.

Figure 9:
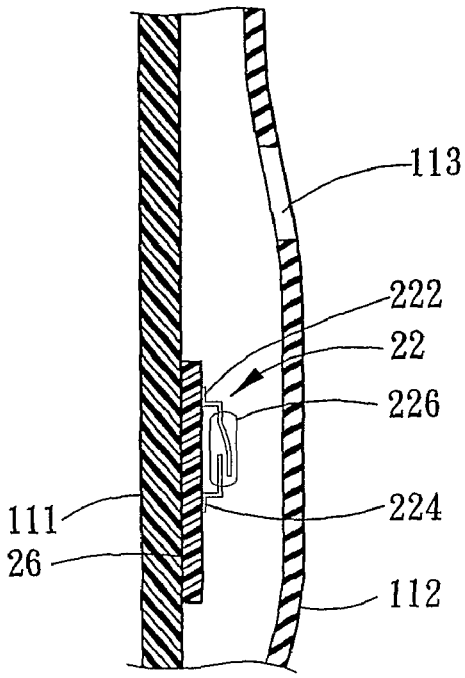
FIG. 9 is a fragmentary sectional view to illustrate the third preferred embodiment of the article in the form of a book according to this invention, illustrating a state where the conductive traces of the first switch unit are disconnected.
Figure 10:
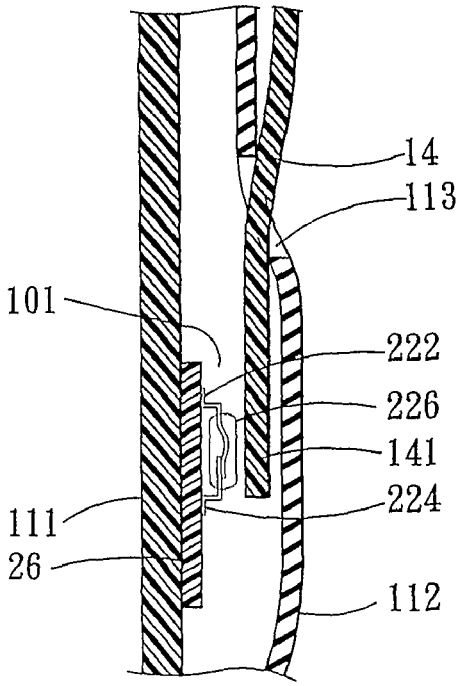
FIG. 10 is a fragmentary sectional view to illustrate how the conductive traces of the first switch unit of the third preferred embodiment are connected through the controlling member.

FIGS. 9 and 10 illustrate the third preferred embodiment of an article in the form of a notebook according to this invention. The notebook of this embodiment differs from the first embodiment in that the first switch unit 22 further has an actuating reed switch 226 coupled to the first and second conductive traces 222, 224. The controlling member 14 is in the form of a card having a magnetic end portion 141 for controlling electrical connection and disconnection between the first and second conductive traces 222, 224 through the actuating reed switch 226 upon insertion and removal of the controlling member 14 into and out of the pocket 101.

Figure 11:
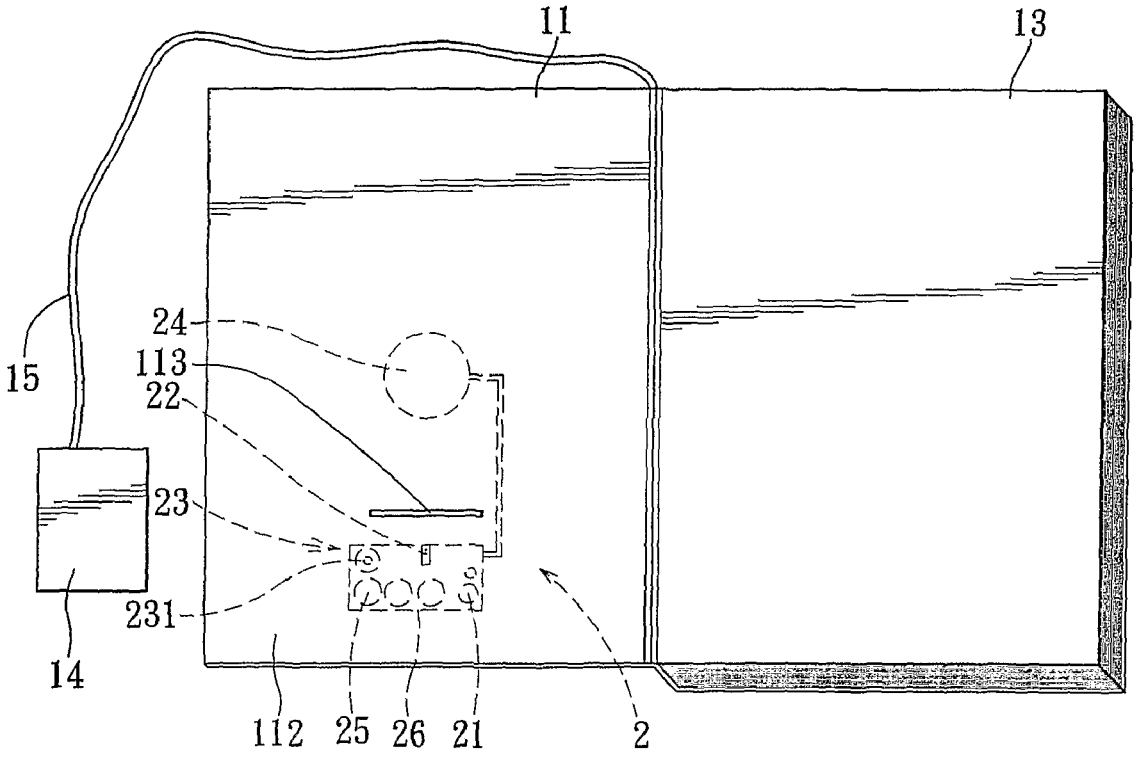
FIG. 11 is a perspective view of the fourth preferred embodiment of an article in the form of a book according to this invention.
Figure 12:
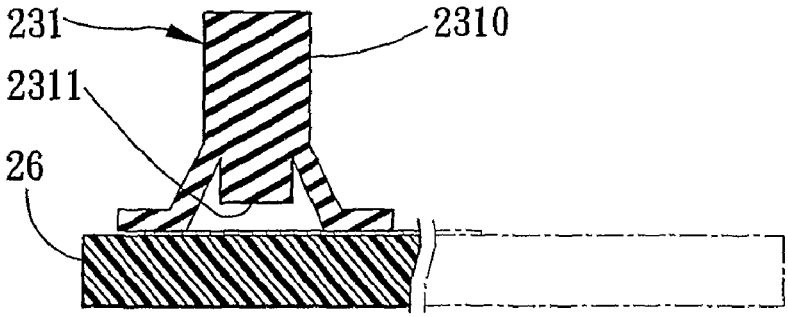
FIG. 12 is a fragmentary sectional view of the fourth preferred embodiment, illustrating a state where conductive contacts of a second switch unit are disconnected.
Figure 13:
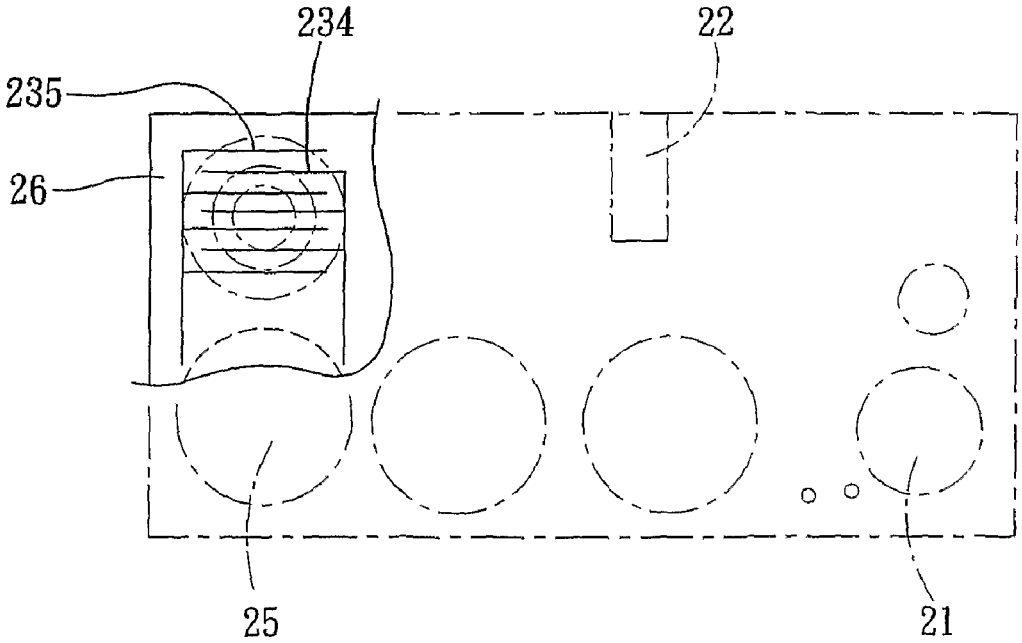
FIG. 13 is a schematic view to illustrate the configuration of the conductive contacts of the second switch unit of the fourth preferred embodiment.

FIGS. 11 to 13 illustrate the fourth preferred embodiment of an article in the form of a book according to this invention. The book of this embodiment differs from the first embodiment in that the second switch unit 23 includes a conductive key switch 231 coupled to the first and second conductive contacts 234, 235, and having a pressable button 2310 that has a conductive contact end 2311 and that is movable between a first pressed position (not shown) and a first non-pressed position (see FIG. 12) for controlling electrical connection and disconnection between the first and second conductive contacts 234, 235, which correspond to respective ones of the operating states of the circuit 2, upon relative movement of the first and second article parts 13, 11 between the first and second positions. At the first pressed position, the conductive contact end 2311 is in electrical contact with the first and second conductive contacts 234, 235. At the first non-pressed position, the conductive contact end 2311 is disconnected from the first and second conductive contacts 234, 235. In this embodiment, the pressable button 2310 is moved to the first pressed position when the first and second article parts 13, 11 are disposed at the first position, and is restored to the first non-pressed position when the first and second article parts 13, 11 are disposed at the second position.

Figure 14:
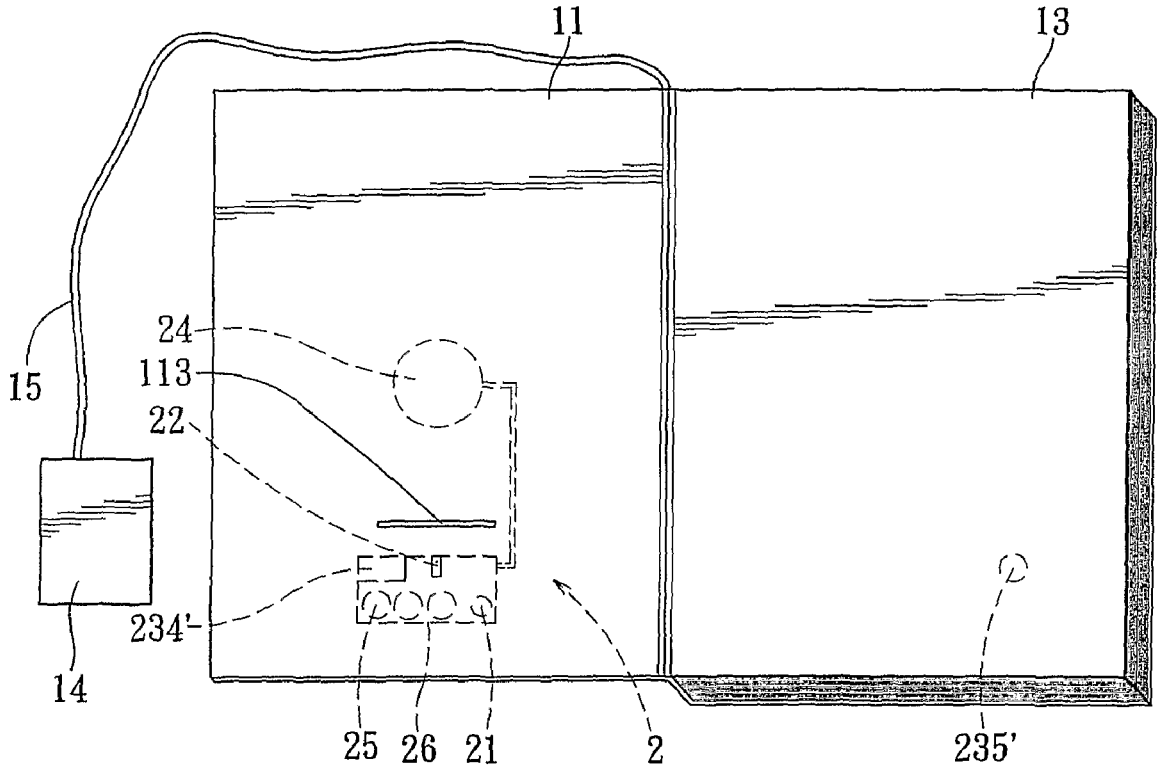
FIG. 14 is a perspective view of the fifth preferred embodiment of an article in the form of a book according to this invention.

FIG. 14 illustrates the fifth preferred embodiment of an article in the form of a book according to this invention. The book of this embodiment differs from the first embodiment in that the second switch unit 23 includes a radio frequency identification (RFID) transceiver 234' provided on the second article part. The first article part 13 is provided with a radio frequency identification (RFID) tag 235'. The RFID transceiver 234' interacts with the RFID tag 235' so as to control the operating states of the circuit 2 upon relative movement of the first and second article parts 13, 11 between the first and second positions.

Figure 15:
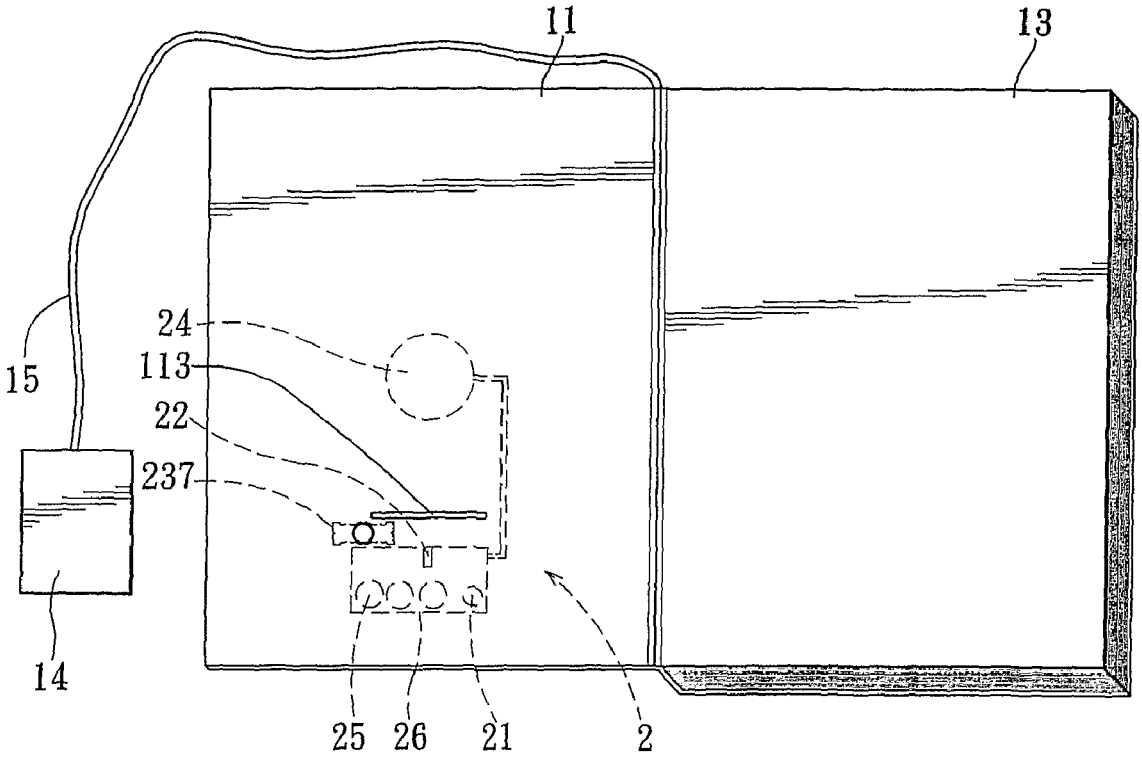
FIG. 15 is a perspective view of the sixth preferred embodiment of an article in the form of a book according to this invention.

FIG. 15 illustrates the sixth preferred embodiment of an article in the form of a book according to this invention. The book of this embodiment differs from the first embodiment in that the second switch unit 23 includes a light sensor 237 for controlling the operating states of the circuit 2 upon relative movement of the first and second article parts 13, 11 between the first and second positions. The light sensor 237 varies in electrical resistance when exposed to a light source.

Unlike the other embodiments, the second switch units of the first and fifth embodiments, which use the reed switch 232 and the RFID transceiver 234', respectively, are actuated when the book is opened, i.e., when the upper cover panel 11' is moved to the second position or the book is turned to any page of the printable sheets 13'.

Figure 16:
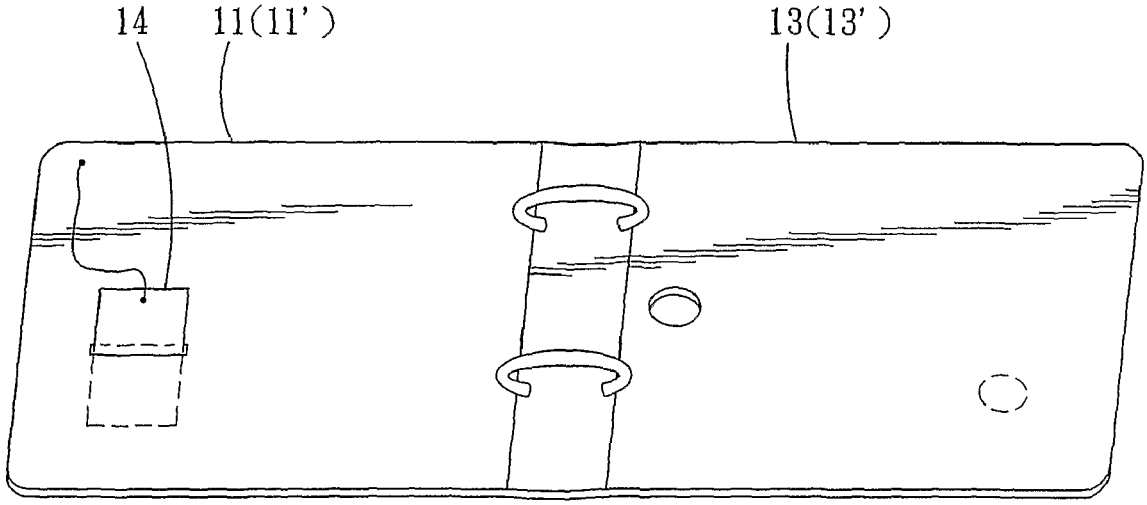
FIG. 16 is a perspective view of the seventh preferred embodiment of an article in the form of a binder according to this invention.

FIG. 16 illustrates the seventh preferred embodiment of an article according to this invention. The article of this embodiment is a binder instead of a notebook. The first and second article parts 13, 11 are respectively the upper and lower cover panels 13', 11'.

Figure 17:
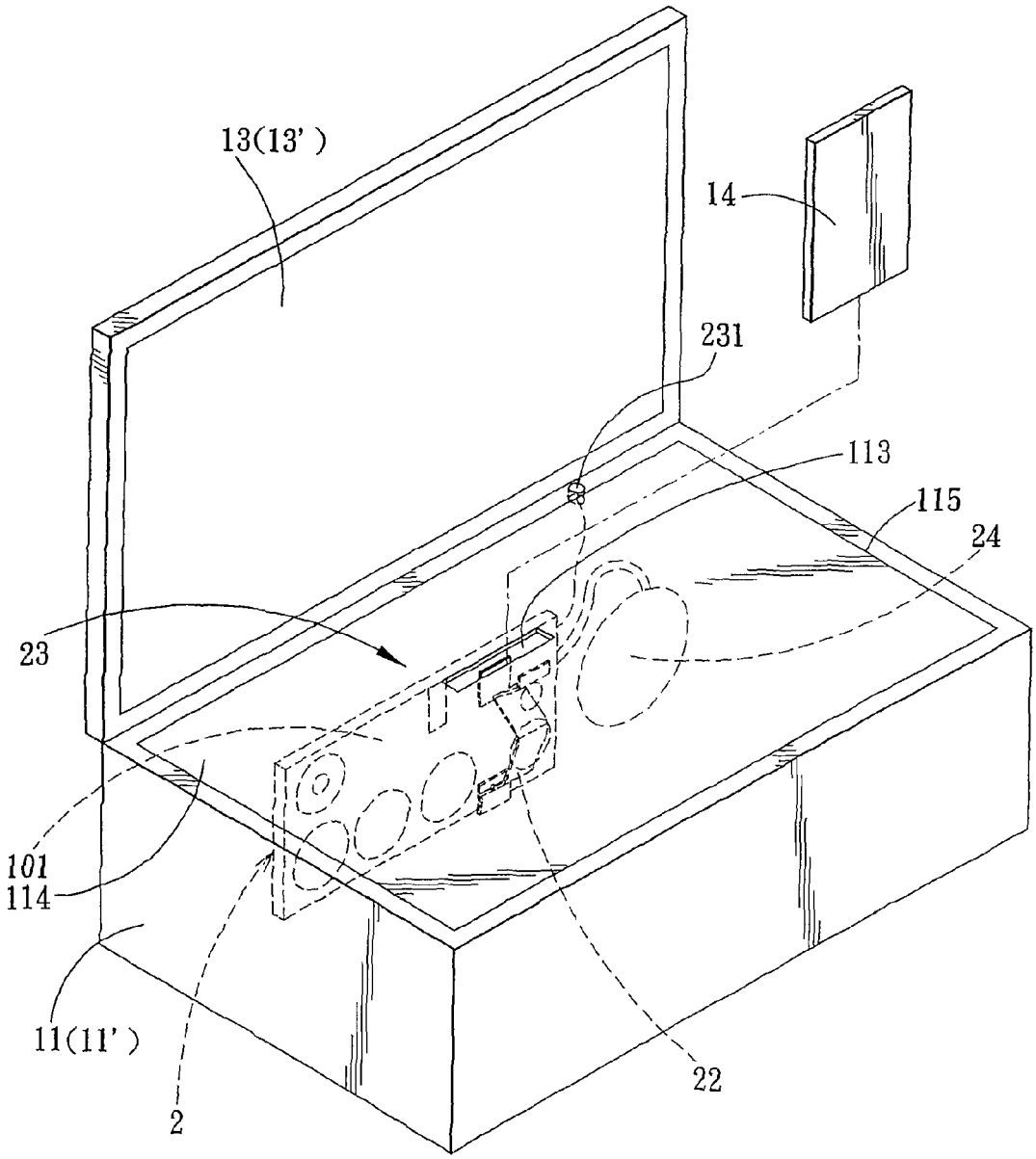
FIG. 17 is a perspective view of the eighth preferred embodiment of an article in the form of a box according to this invention.

FIG. 17 illustrates the eighth preferred embodiment of an article according to this invention. The article of this embodiment is a box instead of a notebook. In this embodiment, the first article part 13 is a lid 13', while the second article part 11 is a box body 11' having an open end 115 that defines an opening. The lid 13' is linked to the open end 115 of the box body 11' for covering the opening in the box body 11'. The pocket 101 with the access opening 113 is formed in a side wall 114 of the box body 11'. The controlling member 14 is in the form of a book mark, a photograph, or a card. The second switch unit 23 includes a pressable button 231 mounted on the open end 115 of the box body 11' so that when the lid 13' is closed or opened, the pressable button 231 is pressed or released, thereby controlling the operating states of the circuit 2.

Figure 18:
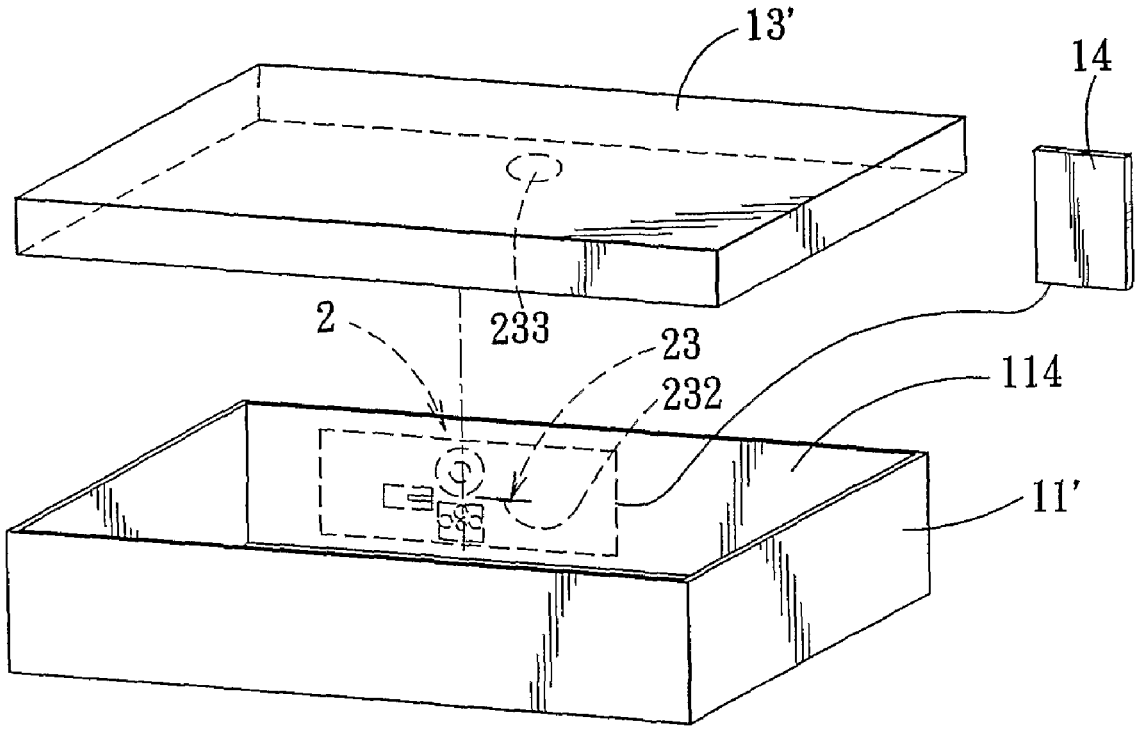
FIG. 18 is a perspective view of the ninth preferred embodiment of an article in the form of a box according to this invention.

FIG. 18 illustrates the ninth preferred embodiment of an article in the form of a box according to this invention. The lid 13' of the box of this embodiment differs from that of the eighth preferred embodiment in configuration. In addition, the second switch unit 23 of the circuit 2 built in a side wall 114 of the box body 11' includes the detecting reed switch 232. The magnetic member 233 is mounted on the lid 13' for interacting with the detecting reed switch 232.

Figure 19:
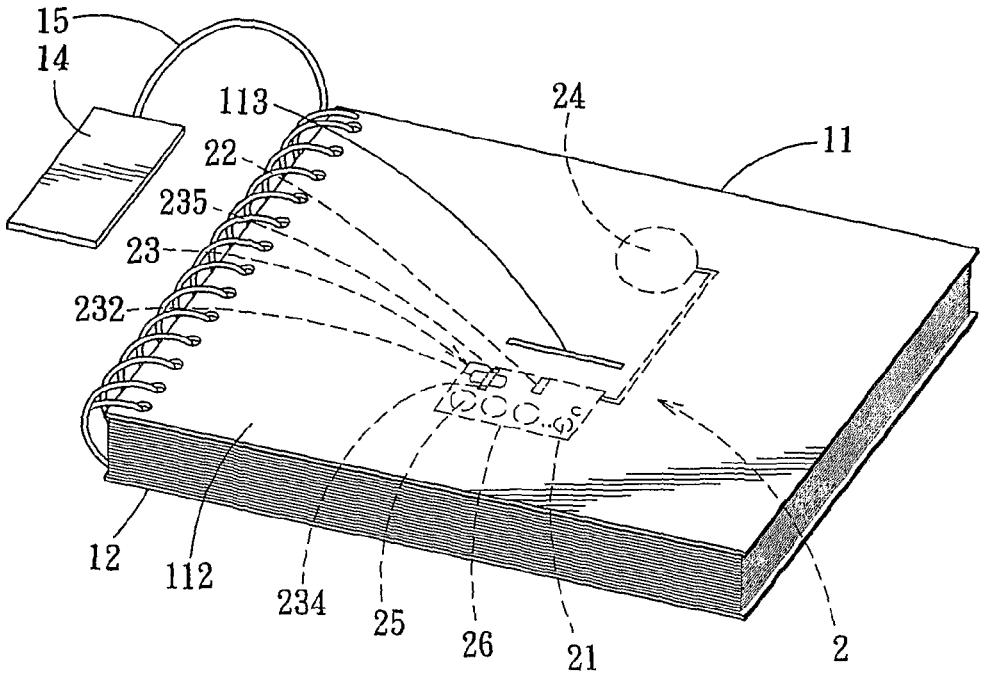
FIG. 19 is a perspective view of the tenth preferred embodiment of an article in the form of a book according to this invention.

FIG. 19 illustrates the tenth preferred embodiment of an article in the form of a book according to this invention. The book of this embodiment differs from the first preferred embodiment in that the access opening 113 is formed in a front cover sheet 114 of the upper cover panel 11' of the second article part 11 instead of the rear cover sheet 112 of the front cover panel 11' in the first preferred embodiment.

Figure 20:
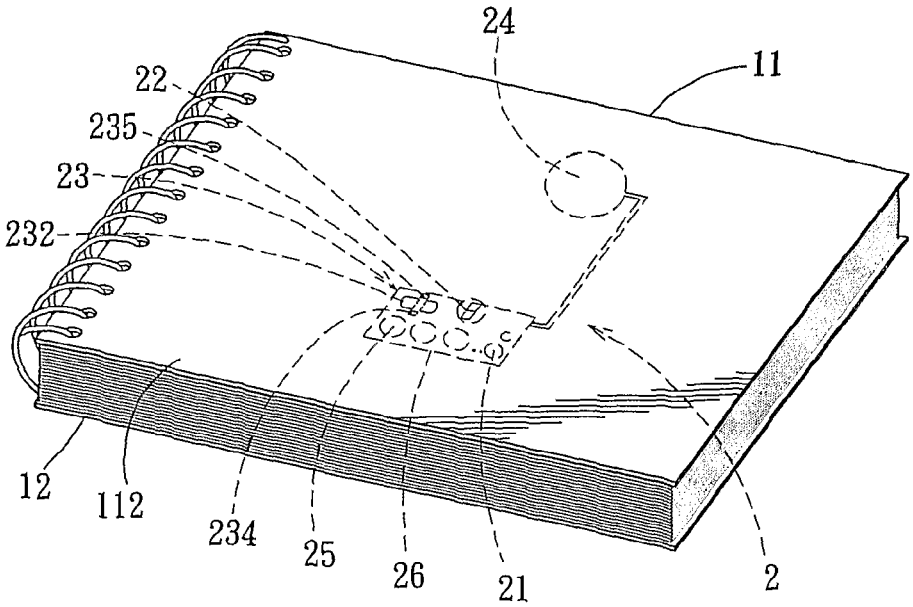
FIG. 20 is a perspective view of the eleventh preferred embodiment of an article in the form of a book according to this invention.
Figure 21:
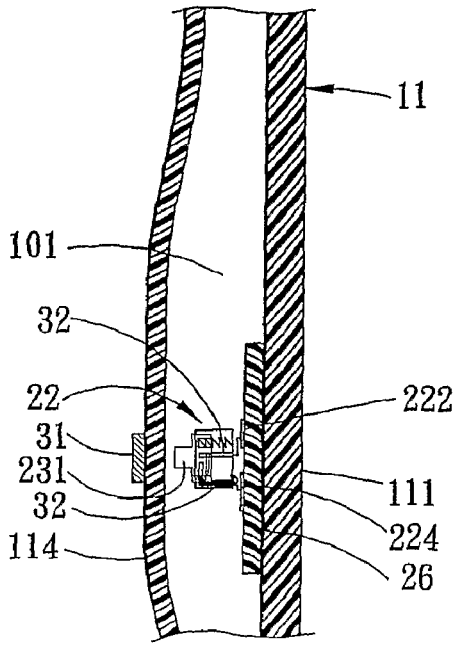
FIG. 21 is a fragmentary sectional view to illustrate a power Off state where two conductive traces of a first switch unit of the eleventh preferred embodiment are disconnected through a first switch unit.
Figure 22:
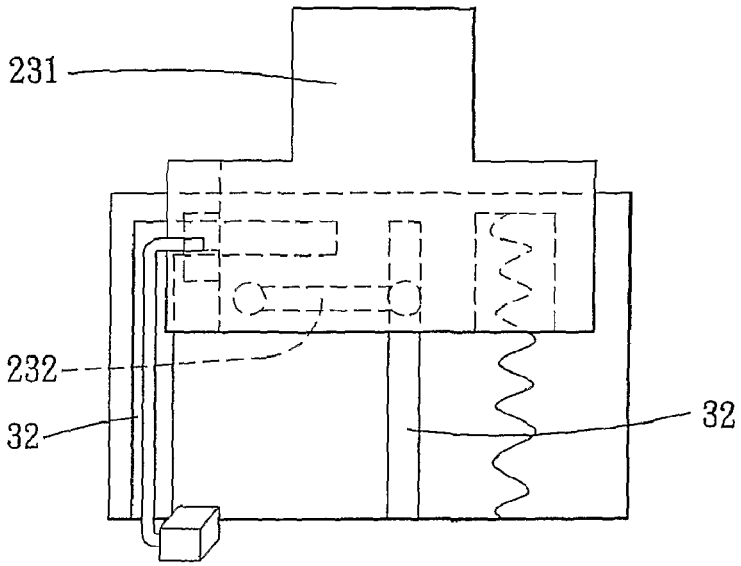
FIG. 22 is a schematic view to illustrate the Off state of the first switch unit in FIG. 21.
Figure 23:
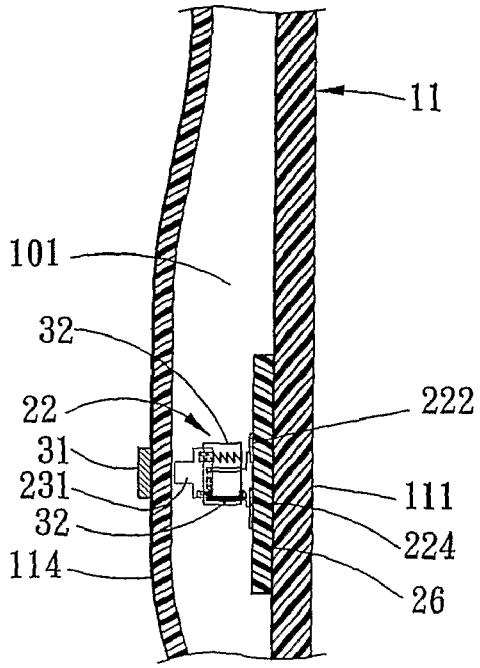
FIG. 23 is a fragmentary sectional view to illustrate a power On state where the two conductive traces of the first switch unit of the eleventh preferred embodiment are connected through the first switch unit.
Figure 24:
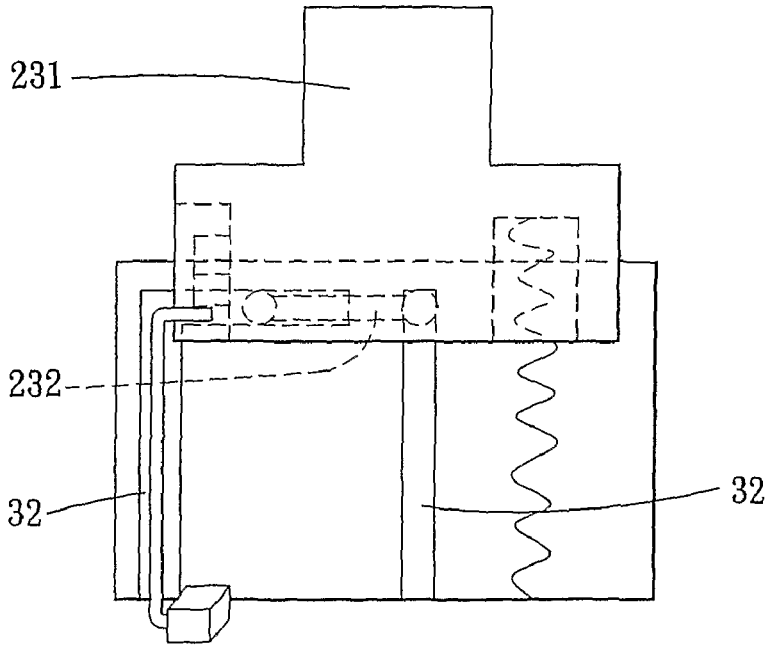
FIG. 24 is a schematic view to illustrate the On state of the first switch unit in FIG. 23.

FIG. 20 illustrates the eleventh preferred embodiment of an article in the form of a book according to this invention. The book of this embodiment differs from the first preferred embodiment mainly in that there is no access opening for access into the pocket 101. In this embodiment, a position indication label 31 (see FIG. 21) is attached to a front cover sheet 114 of the upper cover panel 11' of the second article part 11, and is disposed adjacent to the first switch unit 22 for indicating the operating position of the first switch unit 22. The first switch unit 22 has first and second conductive traces 222, 224 that are formed on the circuit board 26 and that are spaced apart from each other, and a pressable button switch that is mounted on the circuit board 26 and that includes a button 231, first and second conductive connecting members 32 connected electrically and respectively to the first and second conductive traces 222, 224, and a conductive interconnecting member 232. The button 231 is movable between a second pressed position (see FIGS. 21 and 22), in which the conductive interconnecting member 232 is disconnected from at least one of the first and second conductive traces 222, 224, and a non-pressed position (see FIGS. 23 and 24), in which the interconnecting member 232 interconnects the first and second conductive traces 222, 224 through the first and second conductive connecting member 32.

With the inclusion of the pocket 101 formed in the first article part 13 and the first switch unit 22 in the article of this invention, the circuit 2 can be accessed through the access opening 113 of the pocket 101 so as to be controllable by the user using the controlling member 14, thereby eliminating the aforesaid drawback associated with the prior art. Moreover, with the inclusion of the first and second switch units 22, 23 in the article of this invention, various functions can be built in the circuit 2 to increase the attractiveness of the article of this invention.

With the invention thus explained, it is apparent that various modifications and variations can be made without departing from the spirit of the present invention.

What is claimed is:

1. An article with circuit actuating capability, comprising:

a first article part;

a second article part formed with a pocket and linked to said first article part such that said first and second article parts being movable relative to each other, said pocket having an access opening; and a circuit built in said pocket in said second article part and accessible through said access opening of said pocket for controlling circuit states of said circuit; and a controlling member connected detachably to one of said first and second article parts and insertable into said pocket through said access opening for controlling the circuit states of said circuit;

wherein said circuit includes a circuit board disposed in said pocket, and a first switch unit having first and second conductive traces that are formed on said circuit board and that are spaced apart from each other, said controlling member being associated with said first and second conductive traces in such a manner that electrical connection and disconnection between said first and second conductive traces, which correspond to respective ones of the circuit states of said circuit, are controlled by insertion and removal of said controlling member into and out of said pocket.

2. The article of claim 1, wherein said first and second article parts are movable relative to each other between a first position, in which said access opening of said pocket is covered by said first article part, thereby denying access into said pocket, and a second position, in which said access opening of said pocket is exposed from said first article part, thereby permitting access into said pocket.

3. The article of claim 1, wherein said first switch unit further has a resilient conductive spring arm that has a fixed end connected to said second conductive trace, and a free end opposite to said fixed end and aligned with said first conductive trace, said free end of said conductive spring arm being resilient and being self-urged toward and to contact said first conductive trace, said controlling member being in the form of a dielectric card that separates said free end of said conductive spring arm from said first conductive trace when said controlling member is inserted into said pocket.

4. The article of claim 1, wherein said first switch unit further has a resilient conductive spring arm that has a fixed end connected to said second conductive trace, and a free end opposite to said fixed end and spaced apart from said first conductive trace by a gap, said controlling member being in the form of a card with a conductive end portion extending into said gap and sandwiched between and in electrical contact with said free end of said conductive spring arm and said first conductive trace when said controlling member is inserted into said pocket.

5. The article of claim 1, wherein said first switch unit further has an actuating reed switch coupled to said first and second conductive traces, said controlling member being in the form of a card that has a magnetic end portion for controlling electrical connection and disconnection between said first and second conductive traces through said actuating reed switch upon insertion and removal of said controlling member into and out of said pocket.

6. The article of claim 1, wherein said circuit further includes a second switch unit for detecting said first and second positions of said first and second article parts relative to each other, and a controller for receiving signals, which correspond respectively to said first and second positions of said first and second article parts, from said second switch unit so as to control operating states of said circuit, said controller having On and Off power states controlled by the connection and disconnection between said first and second conductive traces which are controlled by insertion and removal of said controlling member into and out of said pocket, said second switch unit including first and second conductive contacts that are formed on said circuit board and that are spaced apart from each other, and a detecting reed switch coupled to said first and second conductive contacts, said first article part being provided with a magnetic member that interacts with said detecting reed switch for controlling electrical connection and disconnection between said first and second conductive contacts, which correspond to respective ones of the operating states of said circuit, upon relative movement of said first and second article parts between said first and second positions.

7. The article of claim 1, wherein said circuit further includes a second switch unit for detecting said first and second positions of said first and second article parts relative to each other, and a controller for receiving signals, which correspond respectively to said first and second positions of said first and second article parts, from said second switch unit so as to control operating states of said circuit, said controller having On and Off power states controlled by the connection and disconnection between said first and second conductive traces which are controlled by insertion and removal of said controlling member into and out of said pocket, said second switch unit including first and second conductive contacts that are formed on said circuit board and that are spaced apart from each other, and a conductive key switch coupled to said first and second conductive contacts, and having a pressable button that is movable between pressed and non-pressed positions for controlling electrical connection and disconnection between said first and second conductive contacts, which correspond to respective ones of the operating states of said circuit, upon relative movement of said first and second article parts between said first and second positions, said pressable button being moved to said pressed position when said first and second article parts are disposed at said first position, and being restored to said non-pressed position when said first and second article parts are disposed at said second position.

8. The article of claim 1, wherein said circuit further includes a second switch unit for detecting said first and second positions of said first and second article parts relative to each other, and a controller for receiving signals, which correspond respectively to said first and second positions of said first and second article parts, from said second switch unit so as to control operating states of said circuit, said controller having On and Off power states controlled by the connection and disconnection between said first and second conductive traces which are controlled by insertion and removal of said controlling member into and out of said pocket, said second switch unit including a light sensor that varies in electrical resistance when exposed to a light source so as to generate the signals upon relative movement of said first and second article parts between said first and second positions.

9. The article of claim 1, wherein said circuit further includes a second switch unit for detecting said first and second positions of said first and second article parts relative to each other, and a controller for receiving signals, which correspond respectively to said first and second positions of said first and second article parts, from said second switch unit so as to control operating states of said circuit, said controller having On and Off power states controlled by the connection and disconnection between said first and second conductive traces which are controlled by insertion and removal of said controlling member into and out of said pocket, said second switch unit including a radio frequency identification (RFID) transceiver, said first article part being provided with a radio frequency identification (RFID) tag, said RFID transceiver interacting with said RFID tag so as to generate the signals upon relative movement of said first and second article parts between said first and second posit ions.

10. The article of claim 1, wherein said first article part includes a lid, said second article part including a box body having an open end that defines an opening, said lid being linked to said open end of said box body for covering said opening in said box body, said box body further having a wall that is formed with said pocket.

11. A book comprising:

a book body formed with a pocket that has an access opening; and a circuit built in said pocket and including a first switch unit that is accessible through said access opening of said pocket to control circuit states of said circuit;

a controlling member connected detachably to said book body and insertable into said pocket through said access opening to engage said first switch unit for controlling circuit states of said circuit;

wherein said circuit further includes a circuit board disposed in said pocket, said first switch unit having first and second conductive traces that are formed on said circuit board and that are spaced apart from each other, said controlling member being associated with said first and second conductive traces in such a manner that electrical connection and disconnection between said first and second conductive traces, which correspond to respective ones of the circuit states of said circuit, are controlled by insertion and removal of said controlling member into and out of said pocket.

12. The book of claim 11, wherein said book body includes a stack of printable sheets that are bound together, and an upper cover panel that is connected to said stack of said printable sheets, that is formed with said pocket, and that is movable relative to said stack of said printable sheets between a first position, in which said access opening of said pocket is covered by said stack of said printable sheets, thereby denying access into said pocket, and a second position, in which said access opening of said pocket is exposed from said stack of said printable sheets, thereby permitting access into said pocket.

13. The book of claim 12, wherein said circuit further includes a second switch unit for detecting said first and second positions of said upper cover panel relative to said stack of said printable sheets, and a controller for receiving signals, which correspond respectively to said first and second positions of said upper cover panel, from said second switch unit so as to control operating states of said circuit, said controller having On and Off power states controlled by the connection and disconnection between said first and second conductive traces which are controlled by insertion and removal of said controlling member into and out of said pocket, said second switch unit including first and second conductive contacts that are formed on said circuit board and that are spaced apart from each other, and a detecting reed switch coupled to said first and second conductive contacts, said book body further including a lower cover panel that is disposed opposite to said upper cover panel and that is provided with a magnetic member that interacts with said detecting reed switch for controlling electrical connection and disconnection between said first and second conductive contacts, which correspond to respective ones of the operating states of said circuit, upon movement of said upper cover panel relative to said lower cover panel between said first and second positions.

14. The book of claim 12, wherein said circuit further includes a second switch unit for detecting said first and second positions of said upper cover panel relative to said stack of said printable sheets, and a controller for receiving signals, which correspond respectively to said first and second positions of said upper cover panel, from said second switch unit so as to control operating states of said circuit, said controller having On and Off power states controlled by the connection and disconnection between said first and second conductive traces which are controlled by insertion and removal of said controlling member into and out of said pocket, said second switch unit including first and second conductive contacts that are formed on said circuit board and that are spaced apart from each other, and a conductive key switch coupled to said first and second conductive contacts, and having a pressable button that is movable between pressed and non-pressed positions for controlling electrical connection and disconnection between said first and second conductive contacts , which correspond to respective ones of the operating states of said circuit , upon movement of said upper cover panel relative to said stack of said printable sheets between said first and second posit ions, said pressable button being moved to said pressed position when said upper cover panel is disposed at said first position, and being restored to said non-pressed position when said upper cover panel is disposed at said second position.

15. The book of claim 12, wherein said circuit further includes a second switch unit for detecting said first and second positions of said upper cover panel relative to said stack of said printable sheets, and a controller for receiving signals, which correspond respectively to said first and second positions of said upper cover panel, from said second switch unit so as to control operating states of said circuit, said controller having On and Off power states controlled by the connection and disconnection between said first and second conductive traces which are controlled by insertion and removal of said controlling member into and out of said pocket, said second switch unit including a light sensor that varies in electrical resistance when exposed to a light source so as to generate the signals upon movement of said upper cover panel between said first and second positions.

16. The book of claim 12, wherein said circuit further includes a second switch unit for detecting said first and second positions of said upper cover panel relative to said stack of said printable sheets , and a controller for receiving signals, which correspond respectively to said first and second positions of said upper cover panel, from said second switch unit so as to control operating states of said circuit, said controller having On and Off power states controlled by the connection and disconnection between said first and second conductive traces which are controlled by insertion and removal of said controlling member into and out of said pocket, said book body further including a lower cover panel that is disposed opposite to said upper cover panel, said second switch unit including a radio frequency identification (RPID) transceiver and a radio frequency identification (RFID) tag provided respectively on said upper and lower cover panels, said RFID transceiver interacting with said RFID tag so as to generate the signals upon movement of said upper cover panel relative to said lower cover panel between said first and second positions.

17. The book of claim 12, wherein said upper cover panel includes a board body and a rear cover sheet covering said board body, said circuit being mounted on said board body and being covered by said rear cover sheet, said access opening of said pocket being formed in said rear cover sheet and being slit-like in shape.

18. The book of claim 11, wherein said first switch unit further has a resilient conductive spring arm that has a fixed end connected to said second conductive trace, and a free end opposite to said fixed end and aligned with said first conductive trace, said free end of said conductive spring arm being resilient and being self-urged toward and to contact said first conductive trace, said controlling member being in the form of a dielectric card that separates said free end of said conductive spring arm from said first conductive trace when said controlling member is inserted into said pocket.

19. The book of claim 11, wherein said first switch unit further has a resilient conductive spring arm that has a fixed end connected to said second conductive trace, and a free end opposite to said fixed end and spaced apart from said first conductive trace by a gap, said controlling member being in the form of a card with a conductive end portion extending into said gap and sandwiched between and in electrical contact with said free end of said conductive spring arm and said first conductive trace when said controlling member is inserted into said pocket.

20. The book of claim 11, wherein said first switch unit further has an actuating reed switch coupled to said first and second conductive traces, said controlling member being in the form of a card that has a magnetic end portion for controlling electrical connection and disconnection between said first and second conductive traces through said actuating reed switch upon insertion and removal of said controlling member into and out of said pocket.

21. An article with circuit actuating capability, comprising:

a first article part;

a second article part linked to said first article part such that said first and second article parts are movable relative to each other between first and second positions;

a circuit built in one of said first and second article parts and having power states and operating states;

a first switch unit coupled to said circuit so as to control said power states of said circuit; and a second switch unit coupled to said circuit so as to detect said first and second positions of said first and second article parts and so as to generate signals corresponding respectively to said operating states of said circuit;

wherein said circuit includes a circuit board disposed in said one of said first and second article parts, said first switch unit having first and second conductive traces that are formed on said circuit board and that are spaced apart from each other, and a pressable button switch that is mounted on said circuit board and that includes a button and a conductive interconnecting member, said button being movable between a pressed position, in which said conductive interconnecting member is disconnected from at least one of said first and second conductive traces, and a non-pressed position, in which said interconnecting member interconnects said first and second conductive traces.

22. The article of claim 21, wherein said second switch unit includes first and second conductive contacts that are formed on said circuit board and that are spaced apart from each other, and a detecting reed switch coupled to said first and second conductive contacts, said first article part being provided with a magnetic member that interacts with said detecting reed switch for controlling electrical connection and disconnection between said first and second conductive contacts, which correspond to respective ones of the operating states of said circuit, upon relative movement of said first and second article parts between said first and second positions.

23. An article with circuit actuating capability, comprising:

a first article part;

a second article part linked to said first article part such that said first and second article parts are movable relative to each other between first and second positions;

a circuit built in one of said first and second article parts and having power states and operating states;

a first switch unit coupled to said circuit so as to control said power states of said circuit; and a second switch unit coupled to said circuit so as to detect said first and second positions of said first and second article parts and so as to generate signals corresponding respectively to said operating states of said circuit;

wherein said first switch unit has first and second conductive traces that are spaced apart from each other, and a pressable button switch that includes a button and a conductive interconnecting member, said button being movable between a pressed position, in which said conductive interconnecting member is disconnected from at least one of said first and second conductive traces, and a non-pressed position, in which said interconnecting member interconnects said first and second conductive traces.

* * * * *